United States Patent [19]

Hasegawa et al.

[11] Patent Number: 4,583,717

[45] Date of Patent: Apr. 22, 1986

[54] METHOD FOR POURING MOLTEN METAL

[75] Inventors: Yoshii Hasegawa; Takeshi Tsuruta; Takao Kohgo; Masahiro Nakamura; Tohru Kishida, all of Wakayama, Japan

[73] Assignee: Sumitomo Metal Industries, Ltd., Osaka, Japan

[21] Appl. No.: 622,123

[22] Filed: Jun. 19, 1984

[30] Foreign Application Priority Data

Jun. 20, 1983 [JP] Japan ..... 58-111441

[51] Int. Cl.[4] ..... B22D 41/00

[52] U.S. Cl. ..... 266/44; 266/92; 222/590

[58] Field of Search ..... 266/44, 78, 80, 99, 266/92, 96, 90; 222/590; 164/155, 154

[56] References Cited

U.S. PATENT DOCUMENTS 3,990,614 11/1974 Matsuo et al. ..... 222/590
4,019,562 4/1977 Shiraiwa et al. ..... 164/155
4,077,457 3/1978 Hashio et al. ..... 164/155
4,355,787 10/1982 Hannes et al. ..... 266/44

FOREIGN PATENT DOCUMENTS 57-4369 1/1982 Japan .
2001154 1/1979 United Kingdom ..... 164/155

*Primary Examiner*—L. Dewayne Rutledge
*Assistant Examiner*—S. Kastler
*Attorney, Agent, or Firm*—Burns, Doane, Swecker & Mathis

[57] ABSTRACT

This invention relates to a method for pouring molten metal, that is applied when molten metal is poured into a vessel or a mold from a pouring apparatus provided with a nozzle having a sliding portion adjustable of an extent of opening, such as a sliding nozzle. The extent of opening of the nozzle is changed periodically with a preset extent of opening as the center of the change. The method enables to prevent that molten metal gets into and solidifies in a gap of the sliding portion of the nozzle, and always to control a pouring amount of molten metal with a stable accuracy. Also, the sliding resistance of the sliding portion of the nozzle is detected, and the extent of opening of nozzle is changed with a vibration width corresponding to the resistance. The method enables to drop off the molten metal adhering and solidifying around the sliding portion of the nozzle, or to maintain a stable control accuracy even when the heat of molten metal causes distortion at the nozzle to change the sliding resistance.

12 Claims, 9 Drawing Figures

METHOD FOR POURING MOLTEN METAL

BACKGROUND OF THE INVENTION

1. Field of the Invention

This invention relates to a method for pouring molten metal which adjusts the extent of opening of an opening adjusting device, such as a sliding nozzle or the like, provided at a molten metal pouring apparatus so that molten metal stored once in the pouring apparatus is poured into other vessels or molds, and more particularly to a method for pouring molten metal which prevents solidifying or adhesion of molten metal to the opening adjusting device, thereby enabling improvement in control accuracy and prevention of clogging to the nozzle.

2. Description of the Prior Art

When molten metal in a tundish at a continuous casting machine is poured into a mold, the level of molten metal poured therein is measured by use of the radiant ray, ultrasonic wave, thermo couple or TV camera and the extent of opening of a sliding nozzle is automatically adjusted on the basis of the measured values so that the level of molten metal is positioned within the reference allowance range providing a dead zone, thereby carrying out the molten metal level control. Such continuous casting method is well known.

The molten metal level control, as shown in FIG. 1, is carried out in such a manner that a level measuring apparatus 5 is mounted at the rear side of a mold 4 to detect the level of molten metal therein, so that in a case where the detected value measured by the level measuring apparatus 5 is higher than the reference allowance range set by a level setting instrument 8, a control signal generated by an adjuster 9 is given to a servo-amplifier 11 to actuate a servo valve 13, thereby adjusting a sliding nozzle 1 in the closing direction through a servo cylinder 12, a pilot cylinder 12' and a work cylinder 7 so as to reduce a sectional area of a molten metal passage, thus reducing a flow rate of molten metal 2 passing through the sliding nozzle 1 from a tundish 3. On the contrary, in a case where the level of molten metal is lower than the reference allowance range, the sliding nozzle 1 is adjusted in the opening direction similarly through the servo cylinder 12, pilot cylinder 12' and power cylinder 7 so as to enlarge the sectional area of the molten metal passage and increase a flow rate of molten metal 2 passing through the sliding nozzle 1 from the tundish 3, thereby adjusting the level of molten metal to be positioned always within the reference allowance range.

However, when the time of pouring under such level control is long, for example, about 30 minutes after a start of pouring, raw metal, as shown by crosshatching in FIG. 2, getting into a gap between fixed plate **1*b* and a sliding plate 1*a* and deposited on the shoulder of inner wall of a sliding nozzle 1 to the sliding plate 1*a* hinders the sliding plate 1*a* from slidable motion. Also, the sliding plate 1*a* is overheated by high temperature of molten metal 2 and distorted, thereby increasing sliding friction at the surface of sliding plate 1*a*** and deteriorating the response to the level control, resulting in that the molten metal level is liable to come out from the reference allowance range.

In detail, a difference (to be hereinafter called the deflection of level) between the levels obtained by the adjuster 9 with respect to the reference allowance range is to be eliminated by the command signal of extent (FIG. 3-(a)) output from the servo-amplifier 11, the servo cylinder 12 operates in response to the command signal as shown in FIG. 3-(b), and the work cylinder 7 is affected by sliding resistance increased by raw metal getting into a gap between the fixed plate **1*b* and the sliding plate 1*a* and deposited and growing up therebetween, and by thermal distortion from overheating, thereby not faithfully following the command signal as shown in FIG. 3-(c). Hence, the control accuracy for the level of molten metal lowers as shown in FIG. 3**-(d), so that there is a defect in that the level of molten metal may come out from the reference allowance range.

OBJECT OF THE INVENTION

A first object of the invention is to provide a method for pouring molten metal which prevents adhesion and solidifying of molten metal onto an opening adjusting device having a sliding portion at a nozzle provided at a pouring apparatus to thereby improve accuracy of pouring control of molten metal.

A second object of the invention is to provide a method for pouring molten metal which improves the control accuracy for the pouring of molten metal regardless of the deflection between the level of molten metal in a vessel to be poured with the molten metal and the set-up level.

A third object of the invention is to provide a method for pouring molten metal which improves the accuracy for the pouring of molten metal regardless of pouring in sliding resistance caused by distortion at the opening adjusting device with the lapse of time and from the heat of molten metal.

A fourth object of the invention is to provide a method for pouring molten metal preventable of clogging to the nozzle at the molten metal pouring apparatus.

The above and further objects and features of the invention will more fully be apparent from the following detailed description with accompanying drawings.

DETAILED DESCRIPTION OF THE INVENTION

Figure 1:
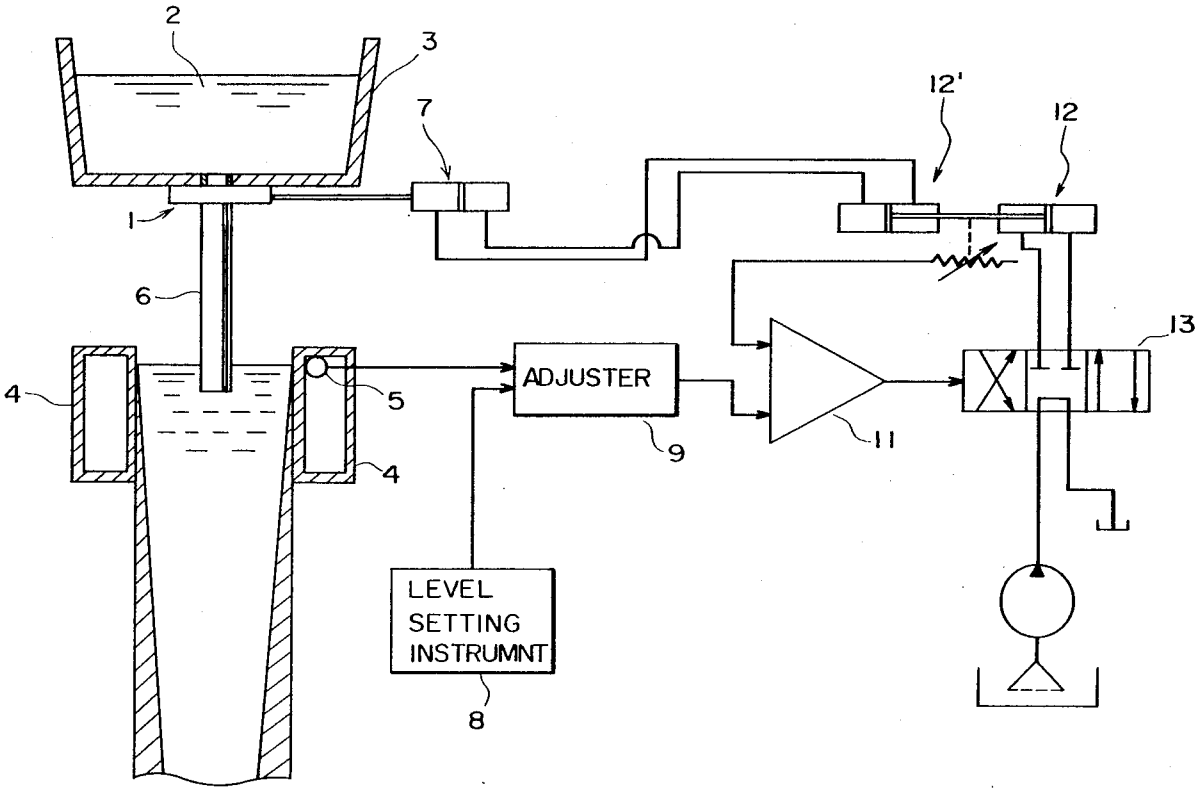
FIG. 1 is an illustration of a conventional method for pouring molten metal.
Figure 2:
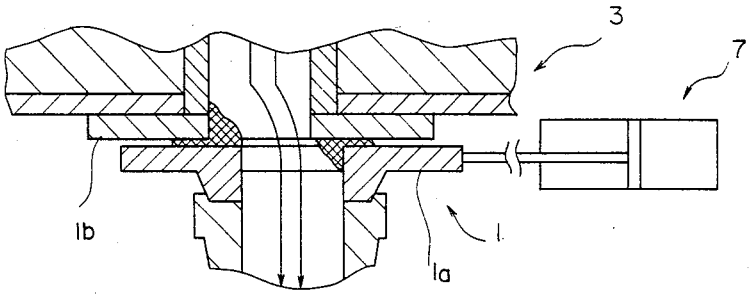
FIG. 2 is a view exemplary of an opening adjusting device (sliding nozzle) and of solidifying and adhesion of molten metal in the conventional method.
Figure 3:
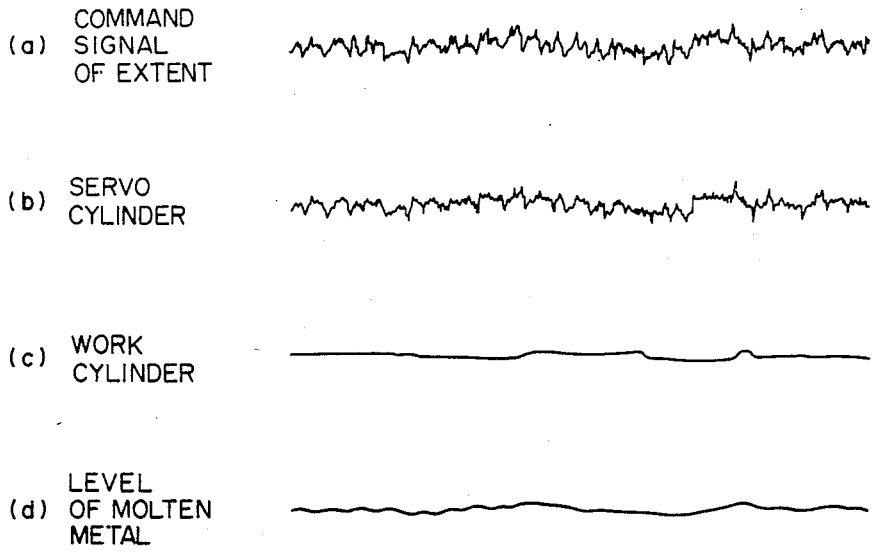
FIG. 3 is a chart showing the molten metal level control in the conventional method.
Figure 4:
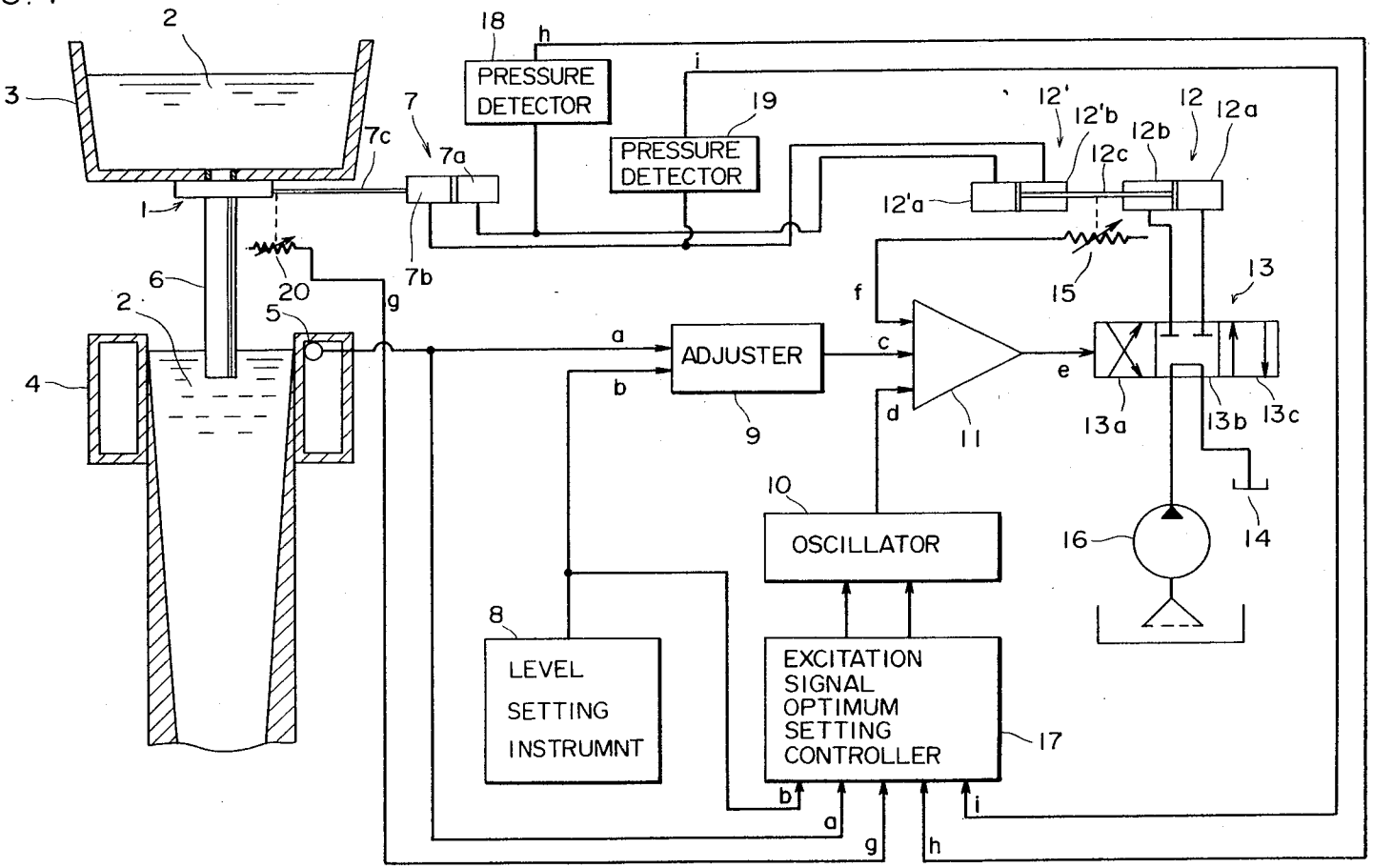
FIG. 4 is an illustration of a method for pouring molten metal of the invention.

Referring to FIG. 4, an embodiment of a method for pouring molten metal of the invention, in which molten steel 2 in a tundish 3 is poured into a mold 4 through a sliding nozzle 1 and an immersion nozzle 6, the sliding nozzle 1 being mounted to the bottom of tundish 3 and controlling a flow rate, in other words, the molten steel level in the mold 4, to pour the molten steel 2 into the mold 4. Also, the sliding nozzle 1, as shown in FIG. 2, comprising a sliding plate 1*a* and fixed plate 1*b* supporting the sliding plate 1*a* slidably in the direction perpendicular to the flow direction of molten steel 2.

The sliding plate 1*a* is provided at the center thereof with a round bore about equal in the size to the inner periphery of sliding nozzle 1 and connects at one end with a rod 7*c* of work cylinder 7.

The work cylinder 7 is of double acting type and has an oil chamber 7*a* for rod advance and that 7*b* for rod retraction, the oil chamber 7*a* communicating with an oil chamber 12'*a* for rod retraction of the pilot cylinder 12', the oil chamber 7*b* communicating with an oil chamber 12'*b* for rod advance of the same. A rod 7*c* of the work cylinder 7 is provided with a cylinder stroke measuring instrument 20 utilizing a variable resistance for measuring the stroke of rod 7*c*, in other words, the position of sliding plate 1*a* of the sliding nozzle 1, so that a measured signal "g" from the measuring instrument 20 is given to an excitation signal optimum setting controller 17.

Also, an oil pressure piping connecting the rod advancing oil chamber 7*a* of the work cylinder 7 and the rod retracting oil chamber 12'*a* of the pilot cylinder 12' and that connecting the rod retracting oil chamber 7*b* of the work cylinder 7 and the rod advancing oil chamber 12'*b* of the pilot cylinder 12', are provided on the way with pressure detectors 18 and 19 respectively.

These pressure detectors 18 and 19 detect pressure of operating oil fed into the oil chambers 7*a* and 7*b* of the work cylinder 7 to thereby detect sliding resistance of sliding plate 1*a* in reciprocation thereof, the detected signals "h" and "i" being given into the excitation signal optimum setting controller 17 respectively.

The pilot cylinder 12' is connected with the servo cylinder 12 through a rod 12*c* in common, the servo cylinder 12 similarly having an oil chamber 12*a* for rod advance and that 12*b* for rod retraction, the oil chambers 12*a* and 12*b* being connected to the load side port of a servo valve 13 of four port three position directional control type, other ports of servo valve 13 being connected to a hydraulic oil source 16 and a tank 14.

The servo valve 13 is changed over on the basis of control signal "e" to a change-over position 13*c* (or 13*a*) at the right side (or the left side) in FIG. 4 to deliver pressure oil from the pressure oil source 16 to the oil chamber 12*b* (or 12*a*) of the servo cylinder 12, so that the pressure oil is delivered to the oil chamber 7*b* (or 7*a*) of the working cylinder to retract (or advance) the rod 7*c*, thereby moving the sliding plate 1*a* in the opening (or closing) direction.

To the cylinder rod 12*c* is attached a cylinder stroke measuring instrument 15 utilizing a variable resistance to measure a stroke of rod 12*c* the measured signal "f" being given as a feedback signal to the servo-amplifier 11.

A well-known level measuring apparatus 5 is provided in the mold 4, which measures the level of molten steel 2 poured into the mold 4 and outputs the measured signals "a" to the adjuster 9 for controlling the level of molten steel 2 and the excitation signal optimum setting controller 17. The level setting instrument 8 is for setting the reference level or range of the molten steel level and outputs a signal "b" relating to the set reference level to the adjuster 9 and excitation signal optimum setting controller 17, the adjuster 9 obtains the deflection of measured signal "a" from the set-up reference position on the basis of the measured signal "a" and signal "b" in relation to the level set-up reference position given into the adjuster 9, so that a control signal "c" to eliminate the deflection is delivered to the servo-amplifier 11.

An oscillator 10 generates an excitation signal "d" for periodically vibrating the sliding plate 1*a* of the sliding nozzle 1, the vibration period and vibration width being controlled by the frequency, amplitude and waveform of the excitation signal "d" given from the oscillator 10. The frequency, amplitude and waveform of excitation signal "d" are decided by the excitation signal optimum setting controller 17 on the basis of the measured signal "a" from the level measuring apparatus 5, signal "b" from the level setting instrument 8, measured signal "g" from the stroke measuring instrument 20 for the rod 7*c* of the work cylinder 7, and detection signal "h" and "i" from the pressure detectors 18 and 19, so that the decided signal is given to the oscillator 10.

The excitation signal optimum setting controller 17 comprises a microcomputer system or an analogue computer and sets the frequency (which defines the vibration cycle period of sliding plate 1*a*), amplitude (which defines vibration width of sliding plate 1*a*), and waveform (sine wave, square wave or triangular wave, etc.) of the excitation signal "d" given from the oscillator 10 to the servo-amplifier 11.

Figure 6:
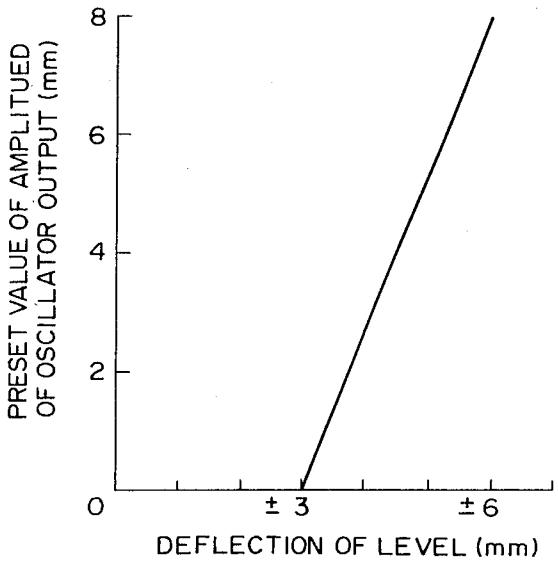
FIGS. 5 and 6 are graphs of an oscillation signal set-up method.
Figure 5:
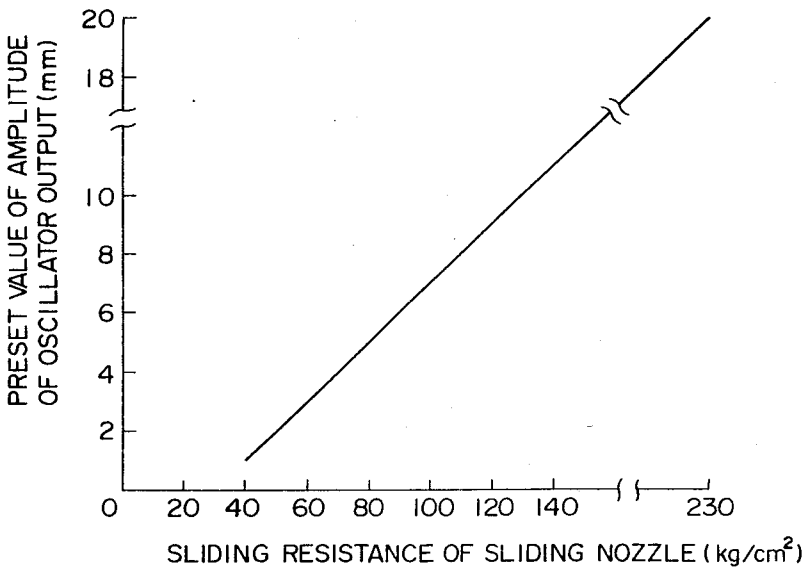

The excitation signal optimum setting controller 17 is previously given a vibration width of sliding plate 1*a* as the translation table or calculating equation as shown in FIGS. 5 and 6. In other words, the vibration width of sliding plate 1*a* corresponding to sliding resistance of sliding plate 1*a* which detected as a change in operation pressure by both the pressure detectors 18 and 19, is decided in such a manner that the larger the sliding resistance is, the larger the vibration width is as shown in FIG. 5. Also, the vibration width of sliding plate 1*a* corresponding to the deflection (concretely, a difference between the signals "a" and "b") between the level of molten steel 2 in the mold 4 measured by the level measuring apparatus 5 and the reference level set by the level setting instrument 8 is decided in such a manner that the larger the deflection of molten steel level is, the larger the vibration width is, as shown in FIG. 6. For example, a vibration width of sliding plate 1*a* corresponding to the sliding resistance and that corresponding to the deflection of molten steel level are calculated in weighted mean at ratios of 7/10 and 3/10 respectively, thereby obtaining a set-up value of vibration width of sliding plate 1*a* so that amplitude (voltage) of signal corresponding to the above set-up value is set in the oscillator 10.

Accordingly, for example, in a case where molten steel 2 adheres and solidifies to a gap for sliding of sliding nozzle 1 or a stepped portion thereof to remarkably increase sliding resistance, the heat of molten steel 2 causes distortion at the sliding plate 1*a* to increase the sliding resistance or the deflection of molten steel level in the mold 4 becomes a larger, the sliding plate 1*a* vibrates in larger amplitude.

On the other hand, the waveform of excitation signal "d" may be sine wave, square wave or triangular wave, the sine wave, when in use, generally smoothening operation of the hydraulic system to cause less trouble. Also, the frequency of excitation signal "d" (vibration cycle period of sliding plate 1*a*) is preferred to be 0.2 Hz to 1.2 Hz in sine wave, 0.2 Hz to 0.6 Hz in square wave, and 0.2 Hz to 1.0 Hz in triangular wave. The reason for this is that the frequency of excitation signal "d" under the lower limit of the abovementioned values is not effective in the prevention of adhesion and solidifying of molten steel 2 at the sliding nozzle 1, and conversely, the same over the upper limit causes no-follow-up of hydraulic system.

The servo-amplifier 11 obtains a difference between the control signal "c" given from the adjuster 9 and the feedback signal: measured signal "f", from the measuring instrument 15 for measuring the movement of cylinder rod 12*c* of the work cylinder 12, and adds to the difference the excitation signal "d", so that a signal thus obtained outputs as a control amount the signal component, the output control signal being given to the servo valve 13. Hence, the sliding plate 1*a* of the sliding nozzle 1 leads to performance of combined movement of movement for eliminating a difference between the signal "b" related to the set-up reference position and the measured signal "a", and vibration of oscillator 10 caused by the excitation signal "d".

Next, concrete explanation will be given on an embodiment of the method for pouring molten metal of the invention. In a bloom continuous casting machine, molten steel 2, for example, of kind: API Grade 5LB, in the tundish 2 is poured into the mold 4 through the sliding nozzle 1 of 60 mm inner diameter, and bloom is drawn out from the mold 4 at the casting speed of 0.6 m/min. The level of molten steel 2 poured into the mold 4 is measured by the level measuring apparatus 5 and the measured signal "a" thereof is delivered to the adjuster 9 and excitation signal optimum setting controller 17, the adjuster 9, on the basis of the measured signal "a" and signal "b" as to the set-up reference position, delivers to the servo-amplifier 11 the control signal "c" allowing the sliding plate 1*a* to have the extent of opening in the closing (or opening) direction when the level of molten steel 2 is higher (or lower) than the reference position.

Also, the servo-amplifier 11 is given the excitation signal "d" from the oscillator 10. The frequency, amplitude (voltage) and waveform are set by the excitation signal optimum setting controller 17, the frequency and waveform being selected properly by hand, the amplitude, as abovementioned, being at first obtained as the vibration width of sliding plate 1*a* on the basis of input signals "a", "b", "g", "h", "i" and so on respectively, whereby the amplitude (voltage) of excitation signal "d" corresponding to the vibration width obtained is set in the oscillator 10.

Now, the frequency of excitation signal "d" given from the oscillator 10 to the servo-amplifier 11 is set 1 Hz and the waveform of the same as sine wave. The servo-amplifier 11 obtains a difference signal (signal of long wavelength shown in FIG. 7-(a)) between the measured signal "f" of cylinder stroke measuring instrument 15 and the control signal "c": the difference between the measured signal "a" of level measuring apparatus 5 given from the adjuster 9 and the set-up signal "b" of level setting instrument 8. The difference signal obtained is superimposed on the excitation signal "d" given from the oscillator 10, whereby the sine wave signal of short wavelength swinging in long wavelength shown in FIG. 7-(a) is obtained as the control signal "c" output from the servo-amplifier 11.

The reference amplitude (for example, amplitude at a start of pouring) of excitation signal "d" is set to be slightly larger than a width of dead zone from the servo-amplifier 11 to the work cylinder 7. Hence, even when the level of molten steel 2 is kept in the set-up value by the level setting instrument 8, the work cylinder 7, in turn the sliding plate 1*a*, vibrates at amplitude corresponding to the difference from the width of dead zone.

Figure 7:
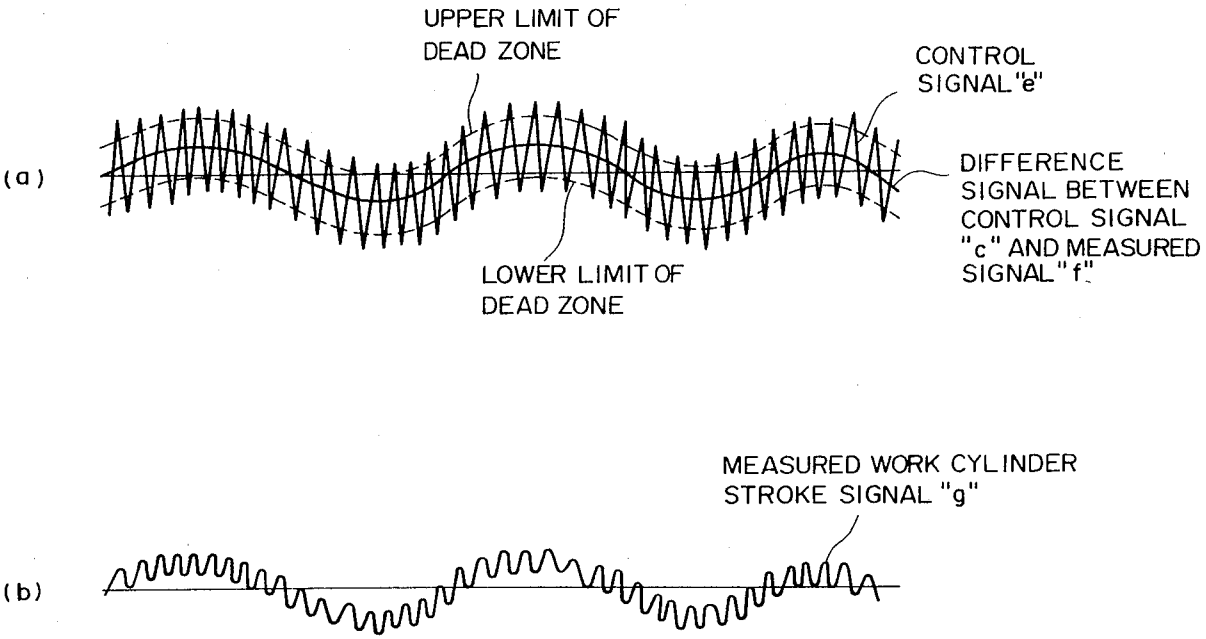
FIG. 7 is a graph showing control signals for level controlling of the method for pouring molten metal of the invention.

Now, assuming that the width of dead zone from the servo-amplifier 11 to the work cylinder 7 is included within a range between two broken lines in FIG. 7-(a), since the control signal "e" output from the servo-amplifier 11 is larger than the width of dead zone only to an extent of the aforesaid difference, the work cylinder 7, as shown in FIG. 7-(b), changes in position for the cycle period corresponding to that of difference signal between the control signal "c" and the measured signal "f" while repeating vibrations in short cycle period.

Figure 8:
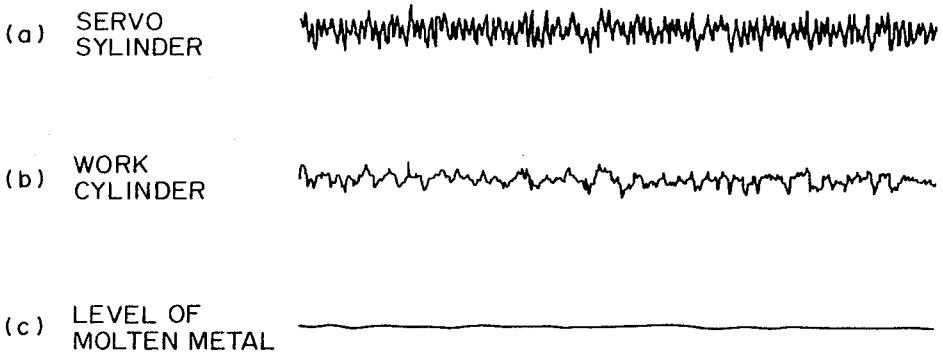
FIG. 8 is a graph showing the state of the level controlling of the method for pouring molten metal of the invention.

The servo valve 13 operates following the control signal "e" supply pressure oil to the servo cylinder 12, or stops to allow the servo cylinder 12 to operate its rod 12*c*, as shown in FIG. 8-(a). Therefore, the work cylinder 7 is actuated so that the sliding plate 1*a* of the sliding nozzle 1 moves in the closing (or opening) direction while intermittently repeating its switching. Therefore, such movement of sliding plate 1*a* can restrict the molten steel 2 from getting into a gap between the wall of sliding nozzle 1 and the sliding plate 1*a* and solidifying therebetween, or from adhering and solidifying to the stepped portion between the inner wall of sliding nozzle 1 and the sliding plate 1*a*, or the molten steel 2, even if once adhered, is easy to drop off, thereby improving the response to the control. Additionally, control of non-apparent dead zone is carried out, whereby the level of molten steel 2 is controlled about to the reference level set by the level setting instrument 8, thus improving to about ±1.5 mm while it is conventionally about ±7 mm.

Now, during the control of the molten steel level as abovementioned, for example, the molten steel 2 may get into a gap of sliding nozzle 1 and solidify, or the heat of molten steel 2 may cause distortion at the sliding plate 1*a*, thereby increasing sliding resistance and lowering the control accuracy, in which an increase in the sliding resistance is detected by the pressure detectors 18 and 19 and the detected signals "h" and "i" are given to the excitation signal optimum setting controller 17, whereby the sliding plate 1*a* is controlled to enlarge its vibration width as abovementioned.

On the other hand, when the level of molten steel 2 changes, the measured signal "a" detected by the level measuring apparatus 5 is given to the excitation signal optimum setting controller 17, whereby when the deflection of molten steel level becomes ±3 mm or more, the sliding plate 1*a* is controlled to enlarge the width of vibration. The excitation signal optimum setting controller 17 takes the weighted mean of both the widths of vibration at a ratio of 7:3, thereby setting to the oscillator 10 the amplitude (voltage) corresponding to vibration width of sliding plate 1*a* as the amplitude of excitation signal "d".

The abovementioned control is carried out to make larger the width of vibration of sliding plate 1*a*. Concretely, the amplitude of excitation signal "d" shown in FIG. 7-(a) exceeds the dead zone of servo-amplifier 11 or the like shown by two broken lines in FIG. 7-(a), thereby being larger. Hence, the control signal "e"

given from the servo-amplifier 11 to the servo valve 13 is larger than that shown in FIG. 7-(b) and swings to both vertical sides in excess of dead zone to thereby enlarge the vibration width of sliding plate 1*a*.

Such control is carried out, so that even when the molten steel 2 adheres and solidifies around the sliding plate 1*a* at the sliding nozzle 1, it is easy to drop off, whereby the sliding plate 1*a* decreases in sliding resistance and returns to the state before the molten steel 2 adheres and solidifies to keep the control accuracy.

In a case where the aforesaid control enlarges the vibration width of sliding plate 1*a*, the position and vibration width thereof may create the danger, but the stroke measuring instrument 20 for the rod 7*c* of the work cylinder 7 always measures the position of rod 7*c*, in turn the position of sliding plate 1*a* and gives the measured signal "g" to the excitation signal optimum setting controller 17, whereby when the work cylinder 7 or sliding plate 1*a* is subjected to an excessive force, the excitation signal optimum setting controller 17 limits the amplitude of excitation signal "d" with respect to the oscillator 10.

Alternatively, in the aforesaid embodiment, the molten steel 2 may be substituted by other molten metals, the work cylinder 7 may be driven by the servo cylinder 12 only, or the servo valve 13 and work cylinder 7 may be driven in combination with each other.

Figure 9:
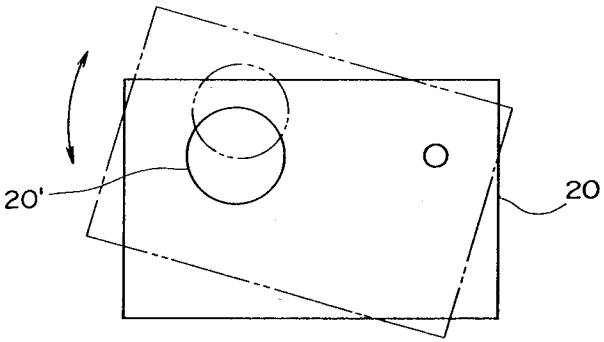
FIG. 9 is a view exemplary of a modified opening adjusting device applicable of the method for pouring molten metal of the invention.

Also, the present invention is not limited in application to the sliding nozzle, but may be applicable to a rotary nozzle which rotates a rotary plate 20 provided with an opening 20' through which the molten metal passes to thereby control the flow rate as shown in FIG. 9.

Also, the vibration mechanism of the opening adjusting device, such as sliding nozzle, is not limited to the hydraulic system, but may use an electric motor, or may be mechanically vibrated.

Furthermore, in a case where; a pouring opening at the bottom of a ladle is provided with a pouring apparatus, such as the sliding nozzle or rotary nozzle through which molten metal is poured into the tundish so that a load cell supervises the weight of molten metal to control the level of molten metal; the opening adjusting device is kept constant and the casting speed or the weight of molten metal in the tundish is changed to control the level of molten metal in the mold; or in combination of both the control methods, the present invention is applicable and also applicable of course to the manual pouring as well as automatic pouring.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A method for pouring molten metal into a vessel and maintaining the level of molten metal at a predetermined level comprising the steps of:

providing a pouring nozzle having a sliding member to vary the extent of opening of the nozzle, periodically changing the extent of opening of the nozzle at a predetermined frequency in response to an excitation signal, measuring the level of molten metal and comparing the measured level to the predetermined level to provide a control signal, indicative of the differences between the levels, superimposing the control signal on said excitation signal to adjust the width of movement of said sliding member.

2. A method for pouring molten metal as set forth in claim 1, wherein a width of the periodical movement in the extent of opening of said nozzle is from 1 mm to 20 mm inclusive.

3. A method for pouring molten metal as set forth in claim 1, wherein the frequency of the periodical movement in the extent of opening of said nozzle is from 0.2 Hz to 1.2 Hz inclusive.

4. A method for pouring molten metal as set forth in claim 2, wherein the frequency of the periodical movement in the extent of opening of said nozzle is from 0.2 Hz to 1.2 Hz inclusive.

5. A method for pouring molten metal into a vessel and maintaining the level of the molten metal in the vessel at an optimum level comprising the steps of:

providing a pouring nozzle having a sliding member to vary the extent of opening of the nozzle, periodically changing the extent of opening of the nozzle at a predetermined frequency in response to an excitation signal, measuring the level of molten metal and comparing the measured level to the predetermined level to provide a control signal, indicative of the differences between the levels, measuring the sliding resistance of the sliding member, making the amplitude of said control signal larger when the sliding resistance becomes larger, superimposing the control signal on said excitation signal to adjust the width of movement of said sliding member.

6. A method for pouring molten metal into a vessel and maintaining the level of molten metal at a predetermined level comprising the steps of:

providing a pouring nozzle having a sliding portion to vary the extent of opening of the nozzle, periodically changing the extent of opening of the nozzle, measuring the level of molten metal and comparing the measured level to the predetermined level to provide a control signal, indicative of the differences between the levels, making the amplitude of said excitation signal larger when said difference of the level of molten metal becomes larger, superimposing the control signal on said excitation signal to adjust the width of movement of said sliding member.

7. A method of pouring molten metal as set forth in claim 5, wherein a width of the periodical change in the extent of opening of said nozzle is from 1 mm to 20 mm inclusive.

8. A method of pouring molten metal as set forth in claim 5, wherein the frequency of the periodical change in the extent of opening of said nozzle is from 0.2 Hz to 1.2 Hz inclusive.

9. A method of pouring molten metal as set forth in claim 7, wherein the frequency of the periodical change in the extent of opening of said nozzle is from 0.2 Hz to 1.2 Hz inclusive.

10. A method of pouring molten metal as set forth in claim 6, wherein a width of the periodical change in the extent of opening of said nozzle is from 1 mm to 2 mm inclusive.

11. A method of pouring molten metal as set forth in claim 6, wherein the frequency of the periodical change in the extent of opening of said nozzle is from 0.2 Hz to 1.2 Hz inclusive.

12. A method of pouring molten metal as set forth in claim 10, wherein the frequency of the periodical change in the extent of opening of said nozzle is from 0.2 Hz to 1.2 Hz inclusive.

* * * * *